US008607594B1

(12) United States Patent
Huang et al.

(10) Patent No.: US 8,607,594 B1
(45) Date of Patent: Dec. 17, 2013

(54) CIRCULAR KNITTED HEAD COVER

(71) Applicants: Yen-Cheng Huang, Huatan Township, Changhua County (TW); Chin-Lung Huang, Huatan Township, Changhua County (TW)

(72) Inventors: Yen-Cheng Huang, Huatan Township, Changhua County (TW); Chin-Lung Huang, Huatan Township, Changhua County (TW)

(73) Assignees: Textraordinary Co., Ltd., Huatan Township, Changhua County (TW); Yen-Cheng Huang, Huatan Township, Changhua County (TW)

( * ) Notice: Subject to any disclaimer, the term of this patent is extended or adjusted under 35 U.S.C. 154(b) by 0 days.

(21) Appl. No.: 13/651,897

(22) Filed: Oct. 15, 2012

(51) Int. Cl.
*D04B 1/24* (2006.01)

(52) U.S. Cl.
USPC ..... 66/171

(58) Field of Classification Search
USPC ..... 66/169 R, 170, 171, 172 R, 172 E; 2/202, 2/203, 204
See application file for complete search history.

(56) References Cited

U.S. PATENT DOCUMENTS 1,235,927 A * 8/1917 Sanborn ..... 2/205
1,421,602 A * 7/1922 Spector et al. ..... 66/171
1,475,653 A * 11/1923 Rosenberg ..... 66/171
1,481,975 A * 1/1924 Bender ..... 66/171
1,587,684 A * 6/1926 Straschill ..... 66/171
1,606,798 A * 11/1926 Karger ..... 66/171
1,638,349 A * 8/1927 Lipper ..... 2/200.1
1,653,181 A * 12/1927 Karger ..... 66/171
1,781,196 A * 11/1930 Rosenberg ..... 66/172 R
1,785,637 A * 12/1930 Lipper ..... 66/171
3,100,896 A * 8/1963 Khanbegian ..... 2/5
3,169,252 A * 2/1965 Goldstein ..... 2/203
3,531,952 A * 10/1970 Chesebro, Jr. ..... 66/171
3,717,882 A * 2/1973 Schuessler ..... 2/173
4,176,409 A * 12/1979 Everitt ..... 2/173
4,272,853 A * 6/1981 Schuessler ..... 2/424
4,300,240 A * 11/1981 Edwards ..... 2/206
4,329,742 A * 5/1982 Schuessler ..... 2/424
4,369,528 A * 1/1983 Vest et al. ..... 2/69
4,571,959 A * 2/1986 Chesebro et al. ..... 66/169 R
4,610,247 A * 9/1986 Stroup ..... 128/201.28
4,825,473 A * 5/1989 Brame ..... 2/202
4,941,211 A * 7/1990 Blutstein ..... 2/202
4,944,041 A * 7/1990 Buenos et al. ..... 2/84
5,062,163 A * 11/1991 Avey ..... 2/424
D331,297 S * 11/1992 Herod ..... D29/106
D331,300 S * 11/1992 Fountain ..... D29/108
5,309,574 A * 5/1994 Balaban et al. ..... 2/202
5,551,087 A * 9/1996 Blutstein et al. ..... 2/173
5,575,009 A * 11/1996 Ryvin ..... 2/173
5,621,920 A * 4/1997 Gorsuch et al. ..... 2/195.8

(Continued)

*Primary Examiner* — Danny Worrell
(74) *Attorney, Agent, or Firm* — Egbert Law Offices, PLLC

(57) ABSTRACT

A circular knitted head cover, used to cover the user's bead, has a long cylindrical cap, integrally circular knitted, flexible, and in the shape of a hollow cylinder. The relative two ends of the long cylindrical cap are respectively formed with an upper cap opening and a lower cap opening. At least one eye through-hole is provided, being an opening integrally knitted on one side of the long cylindrical cap. The eye through-hole enables exposure of the user's eyes when wearing the head cover. An interlaced mouth and nose vent is provided in the shape of interval holes, integrally knitted on one side of the long cylindrical cap and located on a position spaced from the eye through-hole. The interlaced mouth and nose vent enables ventilation of the user's mouth and nose when wearing the head cover.

7 Claims, 6 Drawing Sheets

(56) References Cited

U.S. PATENT DOCUMENTS

| | | | | |
|---|---|---|---|---|
| 5,713,077 | A * | 2/1998 | Humbrecht | 2/173 |
| 5,845,340 | A * | 12/1998 | Frislie | 2/202 |
| D404,846 | S * | 1/1999 | Day | D29/106 |
| 6,681,601 | B2 * | 1/2004 | Li | 66/171 |
| 7,028,345 | B2 * | 4/2006 | Waldman | 2/468 |
| 7,228,858 | B2 * | 6/2007 | Baker | 128/201.22 |
| D624,285 | S * | 9/2010 | Hall | D2/875 |
| 8,141,395 | B2 * | 3/2012 | Dillavou | 66/171 |
| 2005/0160514 | A1 * | 7/2005 | Flaniken | 2/84 |
| 2006/0143797 | A1 * | 7/2006 | Waldman | 2/202 |

* cited by examiner

CIRCULAR KNITTED HEAD COVER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a head cover, and more particularly to an innovative circular knitted head cover with interval-type mouth and nose vent portions.

2. Description of Related Art Including Information Disclosed Under 37 CFR 1.97 and 37 CFR 1.98

A bicycle or motorcycle rider would usually wrap a headscarf on his/her head for protection against the sun, wind or dust. However, such a method to wrap a headscarf on the head requires complicated coiling and knotting in order to obtain a good covering status (i.e., the head, mouth, nose and neck are properly covered). It is very hard to complete the operation for an unskilled person. Therefore, such a method cannot be widely adopted.

In view of the above problem, some relevant manufactures have developed another long cylindrical prior-art headscarf (can also be called head cover). The front side of such long cylindrical prior-art headscarf is perforated with a crosswise long through-hole, so that the user's eyes can be exposed from the through-hole when covering the head with this long cylindrical headscarf. Comparing to headscarf wrapping, this long cylindrical prior-art headscarf is more convenient and offers more complete coverage; however, in practical applications, said long cylindrical prior-art headscarf is still found to have the following problems.

As this long cylindrical prior-art headscarf only has a through-hole in the front side, the user's mouth and ears are both covered inside the headscarf. As a consequent, when the user wearing the headscarf needs to talk to others, the user's voice cannot be transmitted smoothly and will become unclear. On the other hand, as the ears are also covered by the headscarf, the user can not clearly hear other people or the surrounding sounds. Particularly, when the user wants to listen to a mobile phone or earphone when wearing the headscarf, the listening effect will be affected greatly. Such problems seriously influence the practicability of the prior-art long cylindrical headscarf.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The circular knitted head cover disclosed in the present invention features the innovative and unique structure of a long cylindrical cap, an eye through-hole and an interlaced mouth and a nose vent. Compared to the conventionally known structure of prior art, the provision of an interlaced mouth and nose vent can greatly improve the ventilation effect of the user's mouth and nose when wearing the head cover. Moreover, based on the configuration of the interlaced mouth and nose vent in the form of spaced holes, not only the ventilation effect is improved, the mouth and nose parts get sufficient and tight coverage. Therefore, the present invention is practically advanced.

The present invention can generate the following new efficacies:

First, based on another technical feature wherein the long cylindrical cap is provided with ear vents on the two sides, the listening effect of the user's ears can be greatly improved. This is practical and advanced.

Second, based on another technical feature wherein the eye through-hole are in the form of interval holes identical to the interlaced mouth and nose vent, and the configuration area of the eye through-hole and interlaced mouth and nose vent are identical or similar, when the user wears the circular knitted head cover, the user can either insert the head from the upper cap opening or lower cap opening of the long cylindrical cap, and can always obtain the same corresponding effect. Such a two-way wearing function makes the head cover more flexible.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
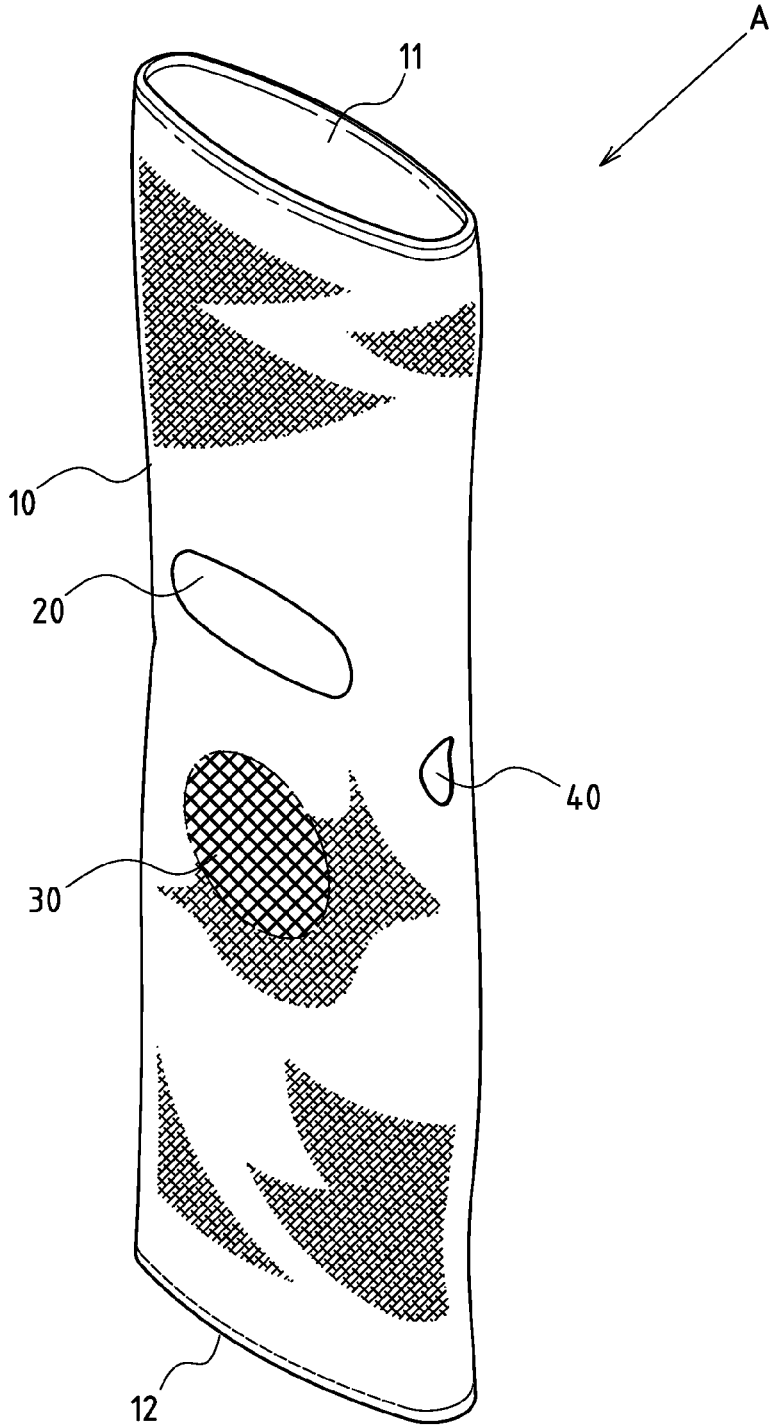
FIG. 1 is a perspective view of a preferred embodiment of the present invention of a circular knitted head cover.
Figure 2:
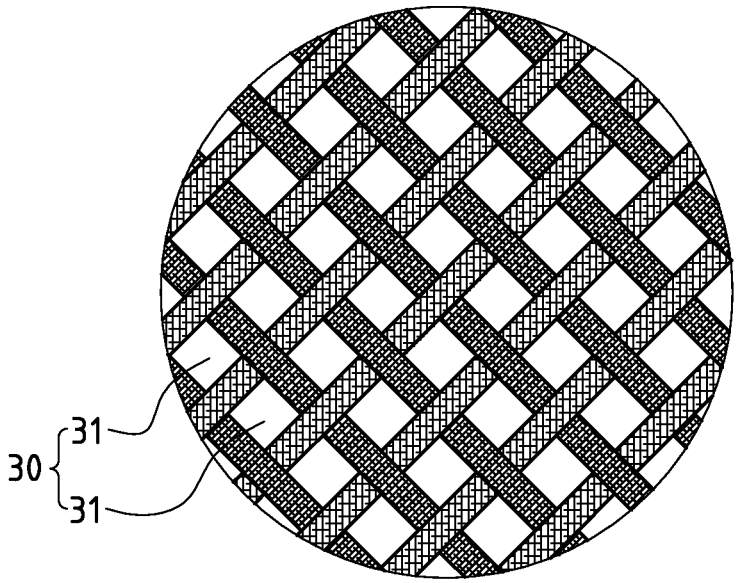
FIG. 2 shows an implementation example wherein the interval holes of the interlaced mouth and nose vent of the present invention are in the shape of meshes.

FIGS. 1 and 2 show a preferred embodiment of the present invention of a circular knitted head cover. However, such an embodiment is illustrative only and is not intending to limit the scope of patent application.

Said circular knitted head cover A is to cap the user's head, and comprises a long cylindrical cap 10, integrally circular knitted, flexible and in a hollow cylindrical shape. The two relative ends of the long cylindrical cap are respectively formed with an upper cap opening 11 and a lower cap opening 12.

Figure 5:
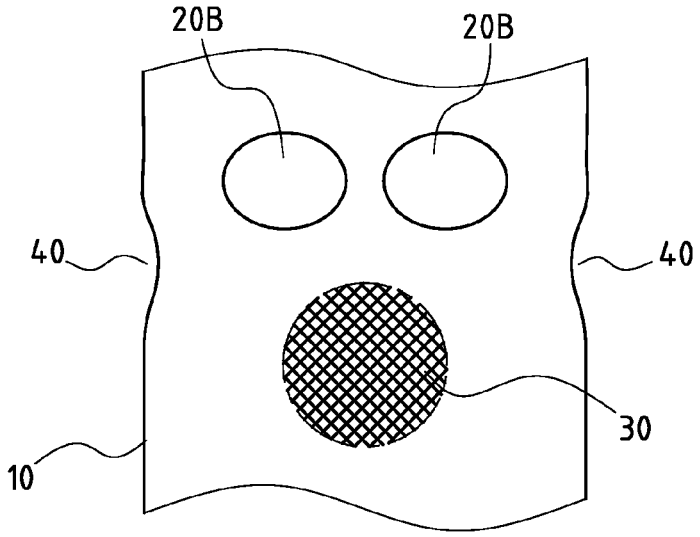
FIG. 5 depicts an embodiment of the present invention with the eye through-hole being two spaced holes.

At least one eye through-hole 20 is provided, being an opening integrally knitted on one side of the long cylindrical cap 10. The eye through-hole 20 enables exposure of the user's eyes when wearing the head cover. The eye through-hole 20 shown in FIG. 1 is a single hole, while the eye through-hole 20B shown in FIG. 5 is double holes arranged with an interval. Here, the term "integrally knitted" means that, when knitting and forming the long cylindrical cap 10, the formation is achieved through programmed actions of the circular knitting machine. The term "integrally knitted" mentioned in other places of this patent description has the same meaning and will not be otherwise defined.

An interlaced mouth and nose vent 30 is provided in a shape made of interval holes 31 (only marked in FIGS. 2 and 3), integrally knitted on one side of the long cylindrical cap 10, and located at an interval position nearby the eye through-hole 20. The interlaced mouth and nose vent 30 enables ventilation of the user's mouth and nose when wearing the head cover. Moreover, the interval holes 31 of the interlaced mouth and nose vent 30 can be implemented as meshes knitted through interlaced weaves, as shown in FIG. 2. Or, like the interval holes 31B shown in FIG. 3, it is implemented as an array of dot holes with obvious space separation.

Figure 6:
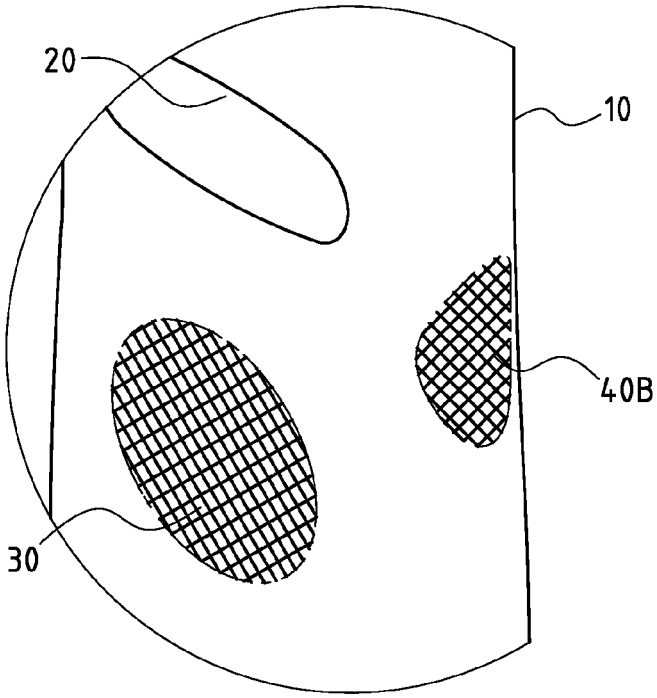
FIG. 6 depicts an embodiment of the present invention with the ear vent being interval holes.
Figure 7:
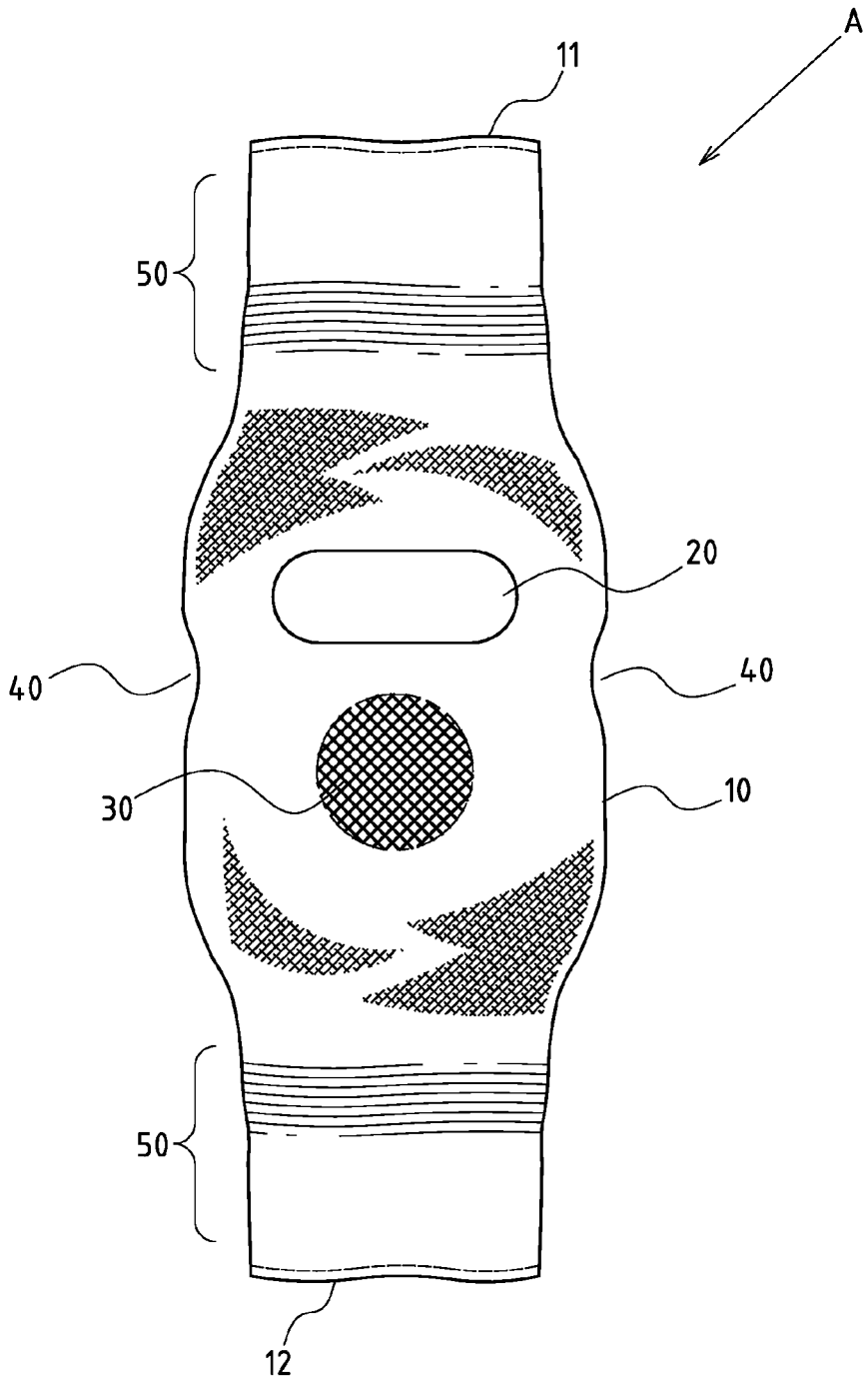
FIG. 7 depicts an embodiment of the present invention with the two ends of the long cylindrical cap of the present invention configured with width shrinking sections.

Referring to FIG. 1, at an interval position on the two sides of the long cylindrical cap 10 between the eye through-hole 20 and interlaced mouth and nose vent 30, there is further provision of ear vents 40 integrally knitted. The ear vent 40 can be in the form of one hole (as shown in FIG. 1) or interval holes (as the ear vent 40B shown in FIG. 6). Configuration of the car vent 40 can enhance the listening effect of the user's ears when wearing the head cover. This is a great help when the user needs talk with others, or listen to the mobile phone or earphone.

Figure 3:
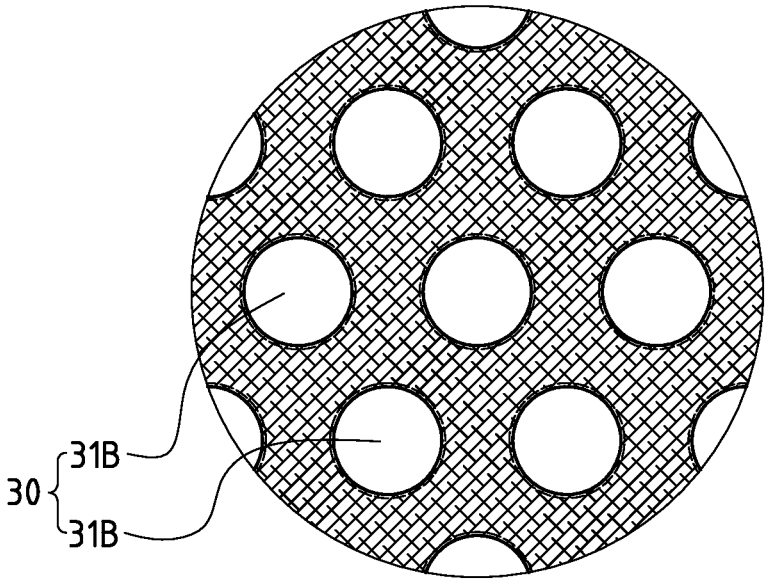
FIG. 3 shows an implementation example that the interval holes of the interlaced mouth and nose vent of the present invention are in the shape of dot arrays.
Figure 4:
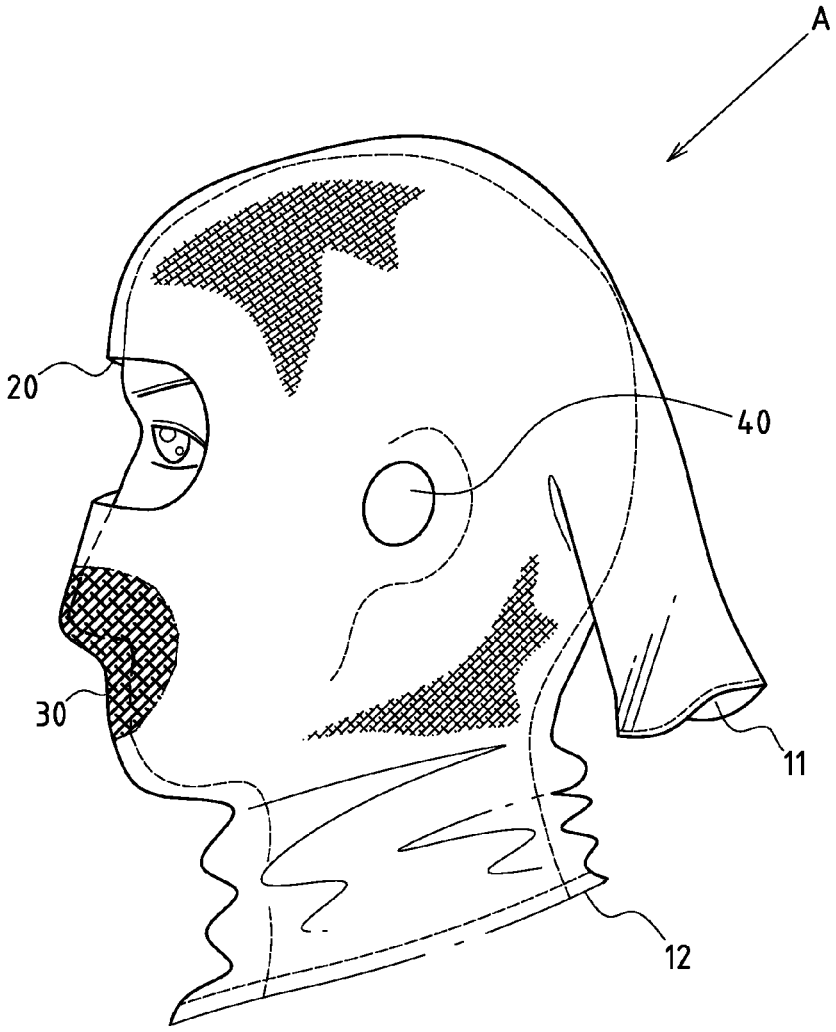
FIG. 4 depicts the state of wearing the circular knitted head cover of the present invention.

The above structures constitute the design of the present invention. Below is a description of the usage state of the present invention:

Referring to FIG. 3 depicting the state of the circular knitted head cover A of the present invention covering the user's head, the user can insert his head from the lower cap opening 12 of the long cylindrical cap 10 till the eye through-holes 20 are corresponding to the eyes, and the interlaced mouth and nose vent 30 is corresponding to the mouth and nose. The wearing of the circular knitted head cover A is completed. Now, the neck of the user will also be covered by the section of the long cylindrical cap 10 close to the lower cap opening 12, while the section of the long cylindrical cap close to the upper cap opening 11 will be projected from the top of the user's head with some length. This projected section can be dropped to the rear part of the head in a natural manner. If the user has long hair, the hair can be pulled out of the upper cap opening 11 along the projected section.

The critical design of the present invention is the configuration of the interlaced mouth and nose vent 30. The opening style of the interval holes enables ventilation and smooth breathing of the user when wearing the head cover, so that the user will not feel stuffy or difficult to breath due to wearing the circular knitted head cover A. And when the user wants to talk with others, the user's voice can be transmitted smoothly through the interlaced mouth and nose vent 30. Hence, when wearing the circular knitted head cover A, the user can still talk with others or use the mobile phone with no difficulty. In addition, as the interlaced mouth and nose vent 30 is in the form of interval holes, the interval holes in this area can still form tightly distributed connection parts. Not only the ventilation effect is improved, the mouth and nose parts get sufficient and tight coverage when wearing the circular knitted head cover A.

Referring to FIG, 7, in the preset area on the two ends of the long cylindrical cap 10 nearby the upper cap opening 11 and lower cap opening 12, further width shrinking sections 50 can be configured. Through configuration of the width shrinking sections 50, when the user wears the circular knitted head cover A, the sections of the long cylindrical cap 10 corresponding to the neck and head top of the user will appear in a state of contraction, so as to enhance the stability and coverage of the head cover.

Figure 8:
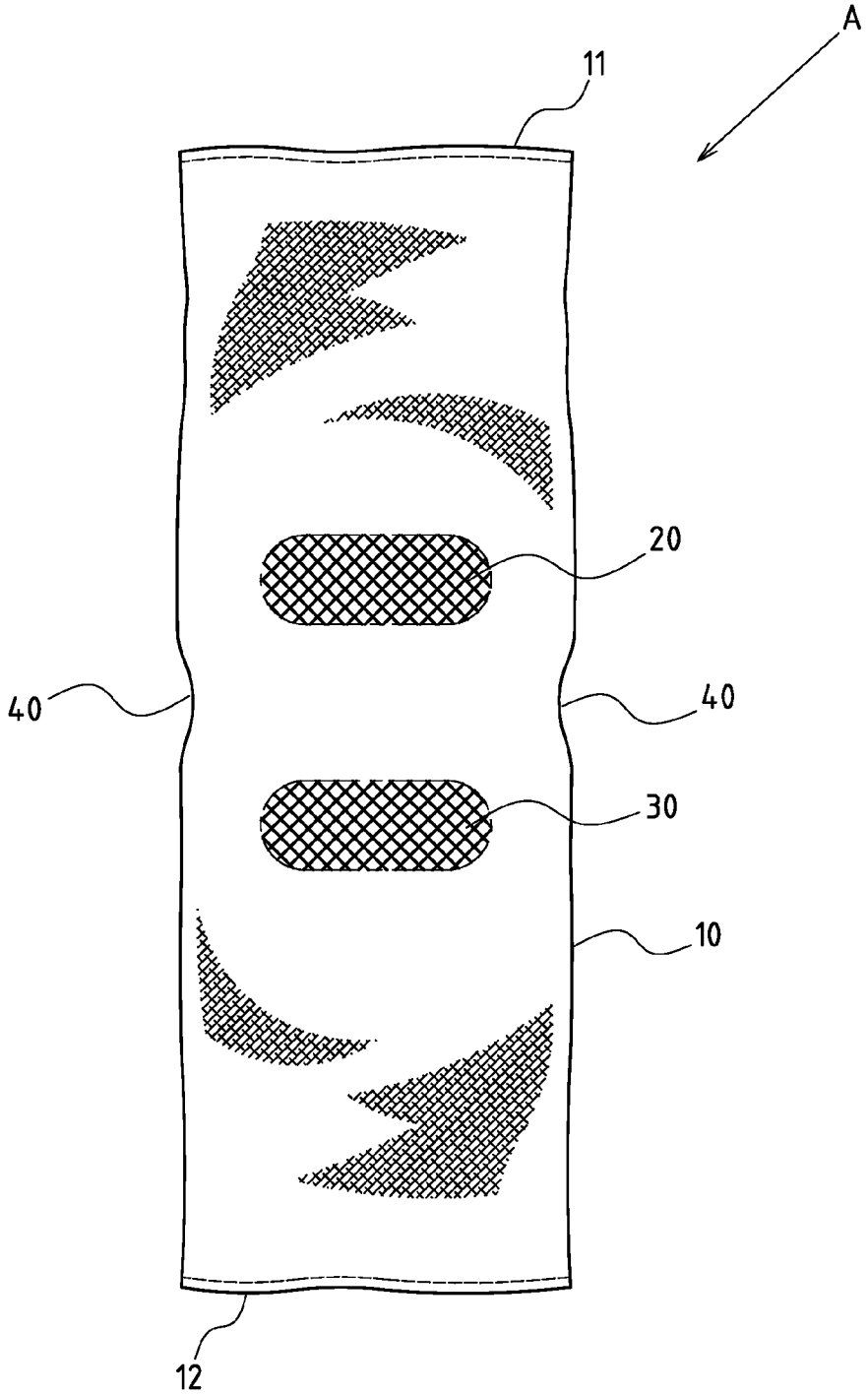
FIG. 8 depicts an embodiment of the present invention with the long cylindrical cap having a two-way wearing function.

Further referring to FIG. 8, the eye through-hole 20 can also be configured in the form of interval holes similar to the interlaced mouth and nose vent 30, and make the area range of the eye through-hole 20 identical or similar to the interlaced mouth and nose vent 30, so that, when the user wears the circular knitted head cover A, the user can either insert the head from the upper cap opening 11 or lower cap opening 12 of the long cylindrical cap 10, and can always obtain the same corresponding effect (i.e., the user's eyes and mouth and nose can always be corresponded to the vent areas). Such a two-way wearing function makes the head cover more flexible. Of course, when considering only the form of the eye through-bole 20, whether it can fulfill the two-way wearing function or not, it can also be provided in the form of interval holes, and the implementation methods of the interval holes can also include those disclosed in FIGS. 2 and 3.

We claim:

1. A head cover for covering a head of a user, the head cover comprising:

an elongated cap being integrally circularly knitted, said elongated cap being flexible and generally cylindrically shaped, said elongated cap having an upper cap opening and a lower cap opening, said elongated cap having a length substantially greater than a length of the head of the user;

at least one eye through-hole integrally knitted on one side of said elongated cap, the eye through-hole suitable for exposing at least one eye of the user when said elongated cap is placed over the head of the user; and a mouth and nose vent having a plurality of holes arranged in spaced relation to each other, said mouth and nose vent integrally knitted on the one side of said elongated cap in spaced relation to the eye through-hole, said mouth and nose vent suitable for allowing ventilation of a nose said a mouth of the user when said elongated cap is applied over the head of the user, said elongated cap having no openings formed between said upper cap opening and the eye through-hole.

2. The head cover of claim 1, the eye through-hole having a shape and a size identical to a shape and a size of said mouth and nose vent.

3. The head cover of claim 1, further comprising:

a pair of ear vents integrally knitted with said elongated cap, said pair of ear vents respectively positioned on opposite sides of said elongated cap in spaced relation to said mouth and nose vent and to the eye through-hole.

4. The head cover of claim 1, said upper cap opening and said lower cap opening having a diameter less than a diameter of a remainder of said elongated cap.

5. The head cover of claim 1, the eye through-hole having a mesh extending thereacross in the form of interlaced weaves.

6. The head cover of claim 1, the eye through-hole having a plurality of holes formed therein in spaced relation to each other.

7. The head cover of claim 1, the plurality of holes of said mouth and nose vent being in the form of a mesh extending thereacross.

* * * * *